US007893831B2

(12) United States Patent
Hoshina et al.

(10) Patent No.: US 7,893,831 B2
(45) Date of Patent: Feb. 22, 2011

(54) ENTRAPMENT PREVENTION SENSOR FOR OPENING AND CLOSING DOOR OF VEHICLE

(75) Inventors: Masaru Hoshina, Toyota (JP); Hironori Koeda, Gifu (JP); Toshio Nakaike, Hiroshima (JP)

(73) Assignee: Nishikawa Rubber Co., Ltd., Hiroshima-Shi, Hiroshima (JP)

( * ) Notice: Subject to any disclaimer, the term of this patent is extended or adjusted under 35 U.S.C. 154(b) by 950 days.

(21) Appl. No.: 11/798,850

(22) Filed: May 17, 2007

(65) Prior Publication Data

US 2007/0273545 A1 Nov. 29, 2007

(30) Foreign Application Priority Data

May 18, 2006 (JP) ..... 2006-138477
Apr. 19, 2007 (JP) ..... 2007-110009

(51) Int. Cl.
*G08B 13/08* (2006.01)

(52) U.S. Cl. ..... 340/545.1; 340/540; 340/545.3; 340/545.8; 340/5.72; 29/897.312; 49/26; 49/502; 49/504

(58) Field of Classification Search ..... 340/540, 340/544, 545.1, 545.3, 545.7, 545.8, 551, 340/552, 5.72; 49/26, 28, 501, 502, 504, 49/479.1; 29/897.2, 897.212; 318/445, 466, 318/480

See application file for complete search history.

(56) References Cited

U.S. PATENT DOCUMENTS 4,884,370 A * 12/1989 Nozaki et al.
4,910,918 A * 3/1990 Naples et al.
5,269,101 A * 12/1993 Nozaki et al.
6,273,433 B1 * 8/2001 Yu
6,297,605 B1 * 10/2001 Butler et al.
6,339,305 B1 * 1/2002 Ishihara et al.
6,393,766 B2 * 5/2002 Nozaki et al.
6,750,624 B2 * 6/2004 Haag et al.
6,836,209 B2 * 12/2004 Ploucha (Continued)

FOREIGN PATENT DOCUMENTS

JP 2004-176426 A 6/2004

OTHER PUBLICATIONS

Hoshina, Masaru, et al., U.S. Appl. No. 12/167,699, entitled "Sensor Protector," and filed Jul. 3, 2008.

*Primary Examiner*—Davetta W Goins
(74) *Attorney, Agent, or Firm*—Buchanan Ingersoll & Rooney PC

(57) ABSTRACT

An entrapment prevention sensor detecting an entrapment of an obstacle between an opening and closing door of a vehicle constituting a first member and including a corner portion and a periphery of a body opening portion constituting a second member, includes a protector including an assembly portion and a hollow portion, the assembly portion assembled onto a fitting flange provided at one of the first and second members, the assembly portion prevented from being provided at the corner portion, a sensor main body accommodated within the hollow portion, and a corner member provided at the corner portion and including a receiving portion and a fixed plate portion, the receiving portion having a hollow and curved shape corresponding to a shape of the corner portion and accommodating the sensor main body, the fixed plate portion including a clip bore and fixed to the fitting flange by means of a clip.

6 Claims, 6 Drawing Sheets

U.S. PATENT DOCUMENTS 6,925,755 B1 * 8/2005 Kyrtsos
6,936,320 B2 * 8/2005 Kubo et al.
7,000,352 B2 * 2/2006 Ishihara et al.
7,135,216 B2 * 11/2006 Tsujiguchi
7,219,945 B1 * 5/2007 Zinn et al. ..... 296/56
7,320,497 B2 * 1/2008 Zinn et al. ..... 296/146.4
7,504,943 B2 * 3/2009 Takeuchi et al. ..... 340/545.1
7,528,703 B2 * 5/2009 Touge ..... 340/435

* cited by examiner

ENTRAPMENT PREVENTION SENSOR FOR OPENING AND CLOSING DOOR OF VEHICLE

CROSS REFERENCE TO RELATED APPLICATIONS

This application is based on and claims priority under 35 U.S.C. §119 to Japanese Patent Application No. 2006-138477 filed on May 18, 2006, and No. 2007-110009 filed on Apr. 19, 2007, the entire content of which is incorporated herein by reference.

FIELD OF THE INVENTION

This invention generally relates to an entrapment prevention sensor. More particularly, this invention pertains to an entrapment prevention sensor for detecting securely an entrapment of an obstacle between an opening and closing door of a vehicle and a body.

BACKGROUND

A known entrapment prevention sensor will be explained with reference to FIGS. 1 to 3. An opening and closing door 2 of a vehicle, which is of a power-driven opening and closing type and is hinged at the top of a body 4, is equipped with an entrapment prevention sensor 40 that detects securely an entrapment of an obstacle such as a hand of a passenger between the opening and closing door 2 and the body 4. The entrapment prevention sensor 40 generally includes a sensor main body 41 that detects an obstacle, and a protector 42 incorporating the sensor main body 41. The protector 42 includes a hollow portion 42*a* and a fitting portion 42*b* having a U shape in cross section. The fitting portion 42*b* is assembled onto a fitting flange 3 provided at the opening and closing door 2 while the hollow portion 42*a* accommodates the sensor main body 41. Alternatively, as disclosed in JP2004-176426A, the protector is integrally formed by means of both extrusion molding and die molding.

Because the protector 42 cannot be formed into a curved shape, the aforementioned entrapment prevention sensor 40 cannot be applied at a corner portion C. Thus, in the opening and closing door 2 of which a lower half portion is formed narrower than an upper half portion as illustrated in FIG. 1, for example, a first sensor portion 40*a* and a second sensor portion 40*b* that are individually and separately constituted are both required on right side and left side of the opening and closing door 2.

Accordingly, a non-detectable area N is present between the first sensor portion 40*a* and the second sensor portion 40*b* where the sensor main body 41 is not provided. The entrapment of an obstacle such as a hand cannot be detected in the non-detectable area N, which raises an issue that the entrapment cannot be avoided. Further, since the first sensor portion 40*a* and the second sensor portion 40*b* are constituted by two separate members, a manufacturing cost may increase and a fitting process may be troublesome.

In the cases where the corner portion is integrally formed by means of extrusion molding and die molding such as illustrated in FIG. 4 of JP2004-176426A, the molding method is complicated and thus a cost increase may be inevitable. As described in a paragraph [0031] of JP2004-176426A, a pressure detection sensor is inserted through a sensor insertion slit formed at a corner door seal portion, which may require a difficult process. According to other examples illustrated in FIGS. 6 and 7 of JP2004-176426A, a fitting portion of a weather strip is arranged without cutting at the corner portion. As a result, a portion of the fitting portion that is in contact with an end portion of a flange and a most outer circumferential portion of a sensor receiving portion differ in view of a circumferential length. The sensor receiving portion having a round hollow shape in cross section is squashed and deformed towards the fitting portion to thereby form into an ellipse shape. Accordingly, the pressure detection sensor is constantly squashed and deformed, which may cause a wrong operation because of hypersensitive reaction.

Thus, a need exists for an entrapment prevention sensor provided between an opening and closing door of a vehicle and a periphery of a body opening portion that can be arranged at a corner portion of the door so as to securely detect an entrapment without a wrong operation and that can achieve a low manufacturing cost and a simple assembly operation.

SUMMARY OF THE INVENTION

According to an aspect of the present invention, an entrapment prevention sensor for an opening and closing door of a vehicle that detects an entrapment of an obstacle between an opening and closing door constituting a first member and including a corner portion and a periphery of a body opening portion constituting a second member and relative to which the opening and closing door approaches and separates, includes a protector made of an elastic member and including an assembly portion and a hollow portion that is integrally formed with the assembly portion, the assembly portion having a U shape in cross section and being assembled onto a fitting flange provided at one of the first and second members, the assembly portion prevented from being provided at the corner portion, a sensor main body accommodated within the hollow portion of the protector, and a corner member provided at the corner portion and including a receiving portion and a fixed plate portion that is integrally formed with the receiving portion, the receiving portion having a hollow and curved shape corresponding to a shape of the corner portion and accommodating the sensor main body, the fixed plate portion including a flat plane shape and a clip bore and fixed to the fitting flange by means of a clip.

According to another aspect of the present invention, an entrapment prevention sensor for an opening and closing door of a vehicle of a power driven opening and closing type and including a corner portion, the entrapment prevention sensor detecting an entrapment of an obstacle between the opening and closing door and a body, includes a protector made of an elastic member and including an assembly portion and a hollow portion that is integrally formed with the assembly portion, the assembly portion having a U shape in cross section and being assembled onto a fitting flange provided at the opening and closing door, the protector prevented from being provided at the corner portion, a sensor main body accommodated within the hollow portion of the protector, and a corner member provided at the corner portion and including a receiving portion and a fixed plate portion that is integrally formed with the receiving portion, the receiving portion having a hollow and curved shape corresponding to a shape of the corner portion and accommodating the sensor main body, the fixed plate portion including a flat plane shape and a clip bore and fixed to the fitting flange by means of a clip.

According to still another aspect of the present invention, an entrapment prevention sensor for an opening and closing door of a vehicle of a power driven opening and closing type and including a corner portion, the entrapment prevention sensor detecting an entrapment of an obstacle between the opening and closing door and a body, includes a protector made of an elastic member and including an assembly portion and a hollow portion that is integrally formed with the assembly portion, the assembly portion having a U shape in cross section and being assembled onto a fitting flange provided at the opening and closing door, the protector configured only by the hollow portion at the corner portion of the opening and closing door, a sensor main body accommodated within the hollow portion of the protector, and a corner member provided at the corner portion and including a receiving portion and a fixed plate portion that is integrally formed with the receiving portion, the receiving portion having a hollow and curved shape corresponding to a shape of the corner portion and accommodating the hollow portion, the fixed plate portion including a flat plane shape and a clip bore and fixed to the fitting flange by means of a clip.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
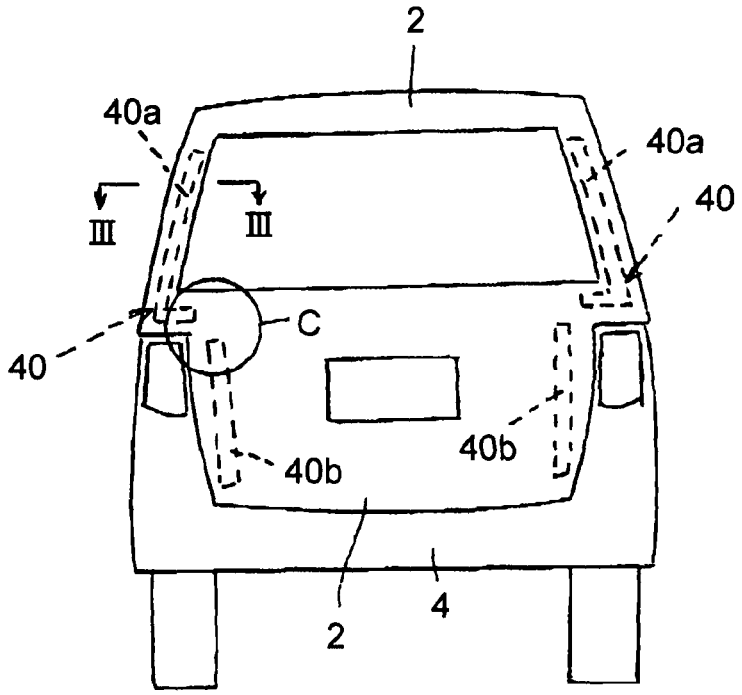
FIG. 1 Prior art
FIG. 1 is a front view of a conventional opening and closing door of a vehicle for illustrating a fitting position of an entrapment prevention sensor for the opening and closing door.
Figure 2:
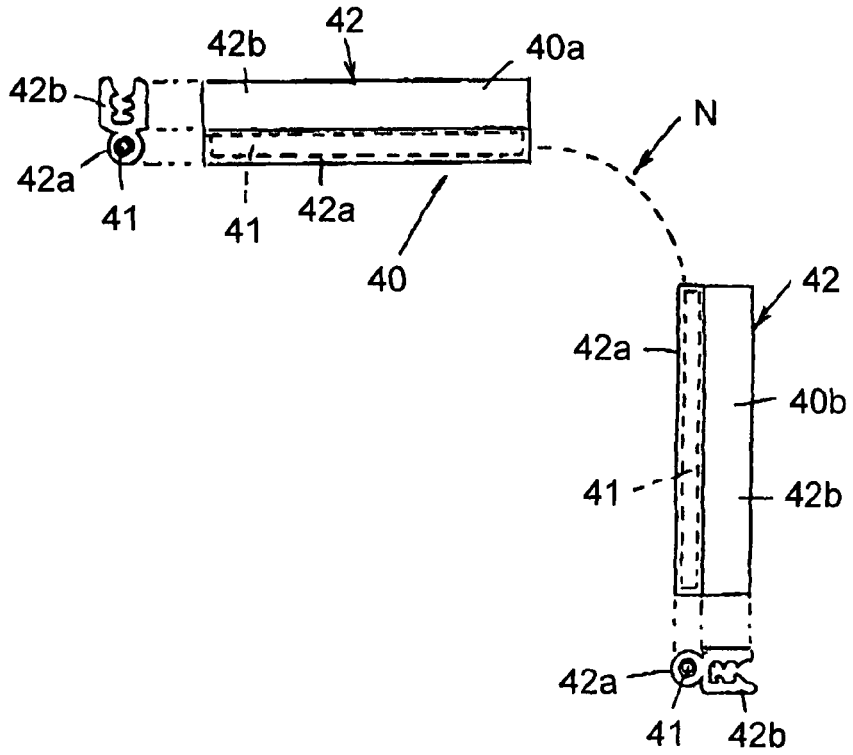
FIG. 2 Prior art
FIG. 2 is a front view of the entrapment prevention sensor provided in the vicinity of a corner portion according to the conventional opening and closing door.
Figure 3:
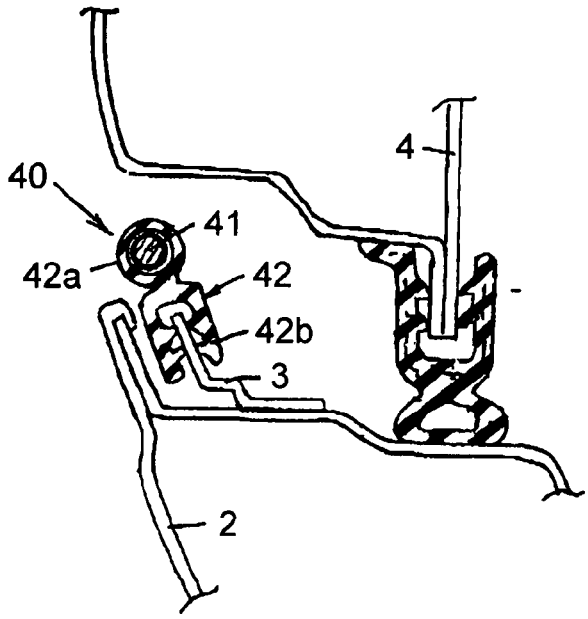
FIG. 3 Prior art
FIG. 3 is a cross-sectional view taken along the line III-III in FIG. 1.
Figure 4:
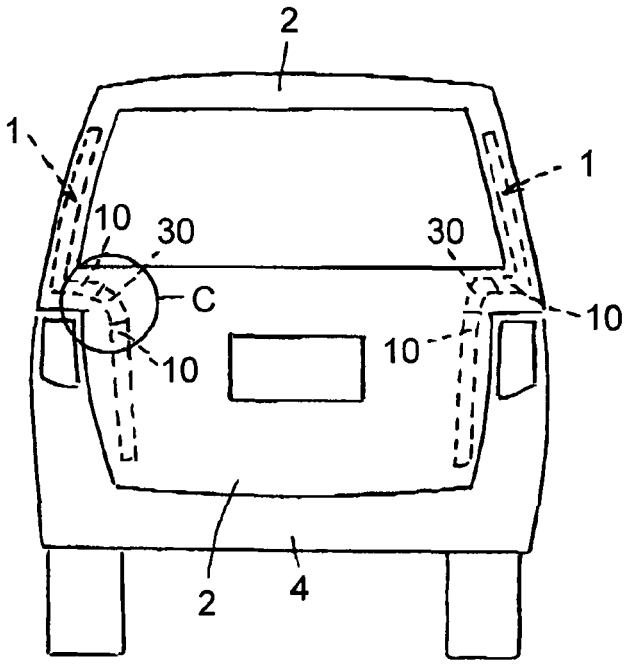
FIG. 4 is a front view of an opening and closing door of a vehicle for illustrating a fitting position of an entrapment prevention sensor for the opening and closing door according to a first embodiment of the present invention.

A first embodiment of the present invention will be explained with reference to FIGS. 4 to 8. As illustrated in FIG. 4, an entrapment prevention sensor 1 of a vehicle according to the first embodiment is provided at an opening and closing door 2 (first member) of a vehicle and includes a corner portion C. The opening and closing door 2 is of a power-driven opening and closing type and is hinged at the top of a body 4. The entrapment prevention sensor 1 including a protector 10 made of an elastic material and a sensor main body 20 detects that an obstacle such as a hand of a passenger is entrapped between the opening and closing door 2 and the body 4. The corner portion C according to the present embodiment is formed as a result of a lower half portion of the opening and closing door 2 that is formed to be narrower than an upper half portion thereof.

Figure 5:
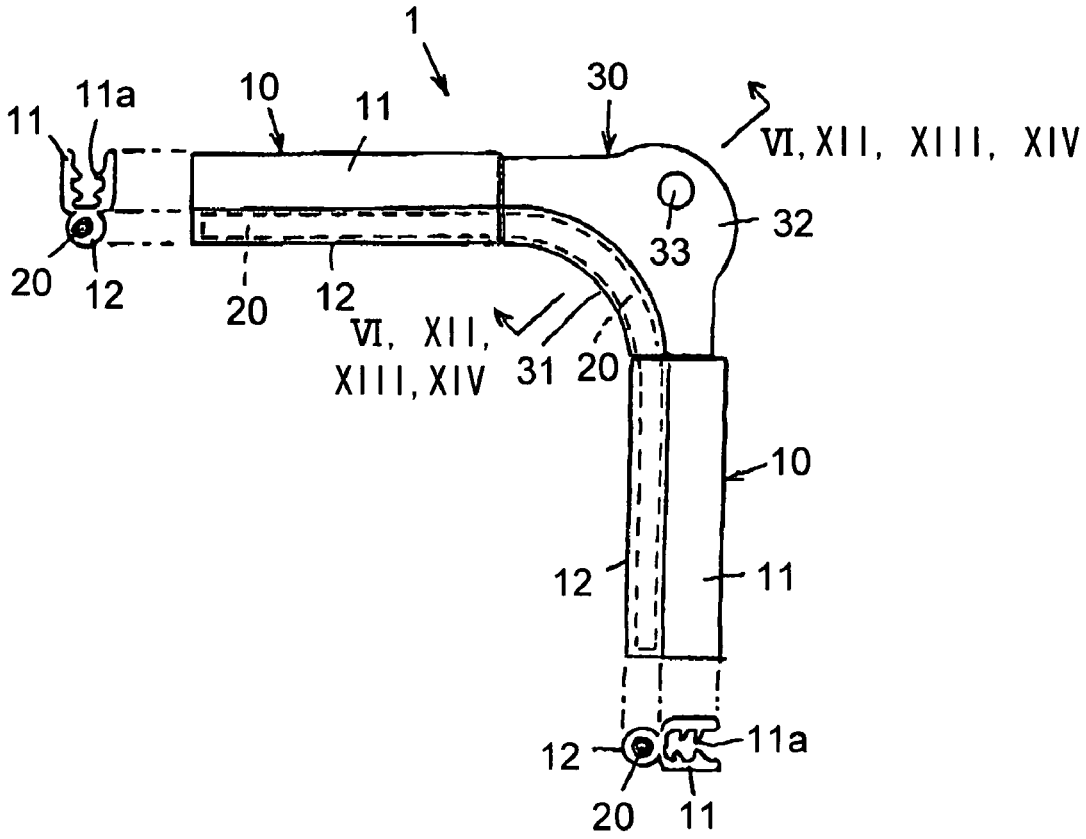
FIG. 5 is a front view of the entrapment prevention sensor provided in the vicinity of a corner portion according to the first embodiment of the present invention.

As illustrated in FIG. 5, the protector 10 includes an assembly portion 11 and a hollow portion 12. The hollow portion 12 has a cylindrical shape in cross section and is integrally formed with the assembly portion 11. The assembly portion 11 having a substantially U shape in cross section includes multiple pawl portions 11*a* and are assembled onto a fitting flange 3 (see FIG. 6) provided at a periphery of an opening portion of a body 4 (second member) As the elastic material for the protector 10, ethylene propylene diene terpolymer, thermoplastic elastomer olefin, or the like is appropriate. The sensor main body 20 is accommodated within the hollow portion 12 of the protector 10 so as to detect an obstacle such as a hand of a passenger.

The protector 10 is not provided at the corner portion C of the opening and closing door 2. That is, instead of the protector 10, a corner member 30 including a fixed plate portion 32 and a receiving portion 31 is provided. Specifically, the fixed plate portion 32 having a flat plate shape and a clip bore 33 is integrally formed with the receiving portion 31 having a curved shape so as to match the shape of the corner portion C and at the same time a hollow cylindrical shape in cross section. The fixed plate portion 32 is fixed to the fitting flange 3 by means of a retainer clip 5 inserted into the clip bore 33 and a fitting bore 3*a* of the fitting flange 3 while the receiving portion 31 accommodates the sensor main body 20.

Accordingly, the sensor main body 20 can be provided in the corner portion C in a protected manner to thereby eliminate a non-detectable area. The occurrence of the entrapment of the obstacle can be further securely detected and the entrapment can be further appropriately avoided. In addition, the sensor main body 20 is arranged through the protector 10 and the corner member 30 as an integral structure, which can achieve a simple fitting process. Further, the corner member 30 is fixed by means of the retainer clip 5, thereby further enhancing the simple fitting process.

Figure 7:
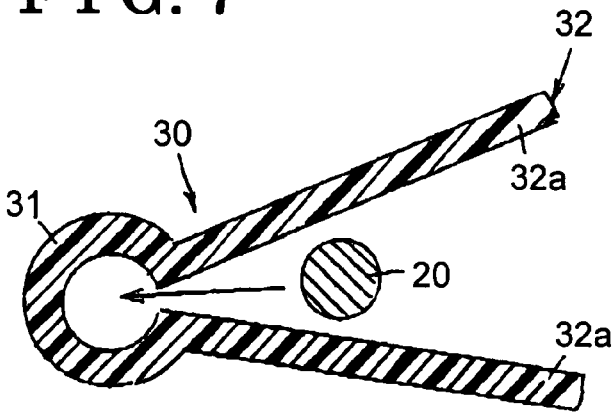
FIG. 7 is a cross-sectional view illustrating a state where a protector shown in FIG. 5 is opened.
Figure 8:
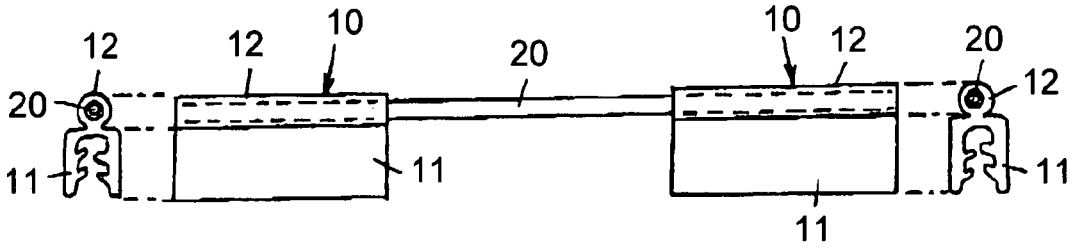
FIG. 8 is a structural view illustrating the protector and a sensor main body according to the first embodiment of the present invention.

According to the present embodiment, the fixed plate portion 32 is formed by two plate members 32*a* overlapping each other. Then, a portion of the receiving portion 31 facing the fixed plate portion 32 is divided into two parts, which are integrally connected to the respective plate members 32*a* to form a split pin shape. Accordingly, it is possible to open the two plate members 32*a* so as to bring the receiving portion 31 to an open state and to receive the sensor main body 20 as illustrated in FIG. 7. As a result, the sensor main body 20 can be easily received in the receiving portion 31, which can further simplify the fitting process of the corner member 30. Further, the sensor main body 20 can be fully protected all round by the receiving portion 31.

The shape of the corner member 30 is not limited to the above. For example, the fixed plate portion 32 may be formed by a single plate member and a notch portion may be formed at a desired portion of the receiving portion 31 for receiving the sensor main body 20. The sensor main body 20 can be inserted from the notch portion to be positioned within the receiving portion 31.

Figure 9:
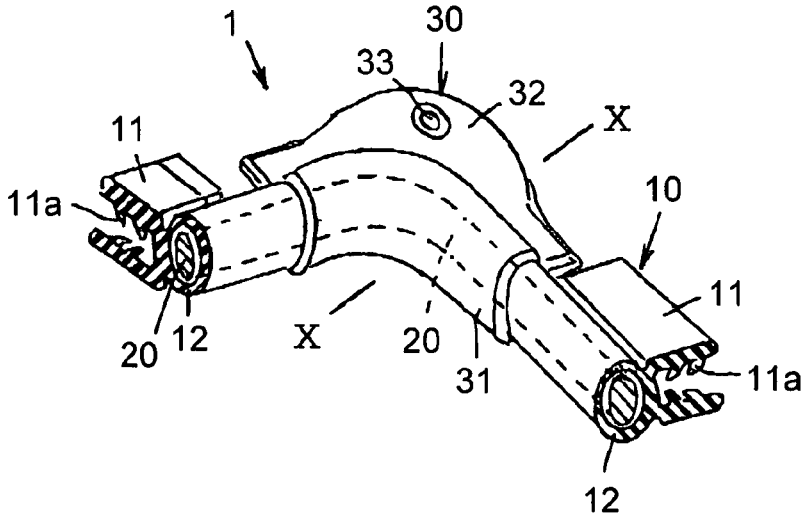
FIG. 9 is a perspective view of an entrapment prevention sensor for an opening and closing door according to a second embodiment of the present invention.
Figure 10:
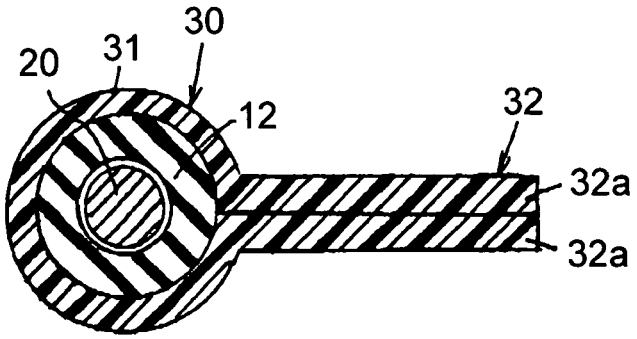
FIG. 10 is a cross-sectional view taken along the line X-X in FIG. 9.
Figure 11:
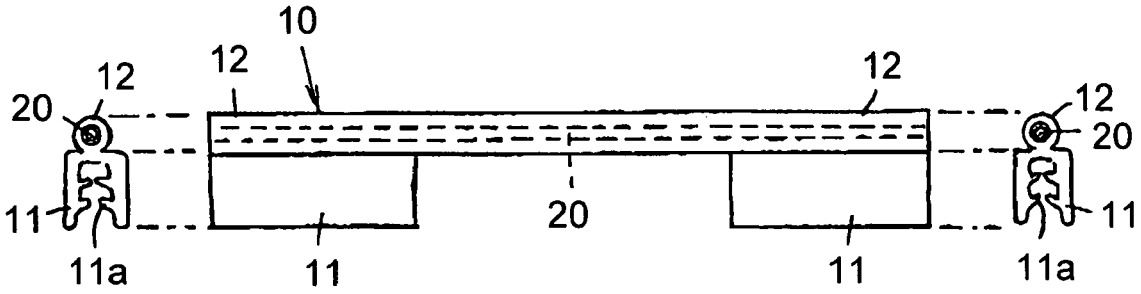
FIG. 11 is a structural view illustrating a protector and a sensor main body according to the second embodiment of the present invention.

Next, a second embodiment of the entrapment prevention sensor 1 will be explained with reference to FIGS. 9 to 11. According to the second embodiment, the protector 10 is configured only by the hollow portion 12 at the corner portion C. At the same time, provided at the corner portion C is the corner member 30 constituted by the fixed plate portion 32 having the flat plate shape and the clip bore 33, and the receiving portion 31 having the curved and hollow shape and integrally formed with the fixed plate portion 32. Then, the hollow portion 12 accommodating the sensor main body 20 is received in the receiving portion 31.

According to the entrapment prevention sensor 1 of the second embodiment, the sensor main body 20 can be also provided at the corner portion C in a protected manner to thereby eliminate the non-detectable area. Accordingly, the occurrence of the obstacle can be further securely detected and the entrapment can be further appropriately avoided.

According to the second embodiment, the sensor main body 20 and the protector 10 are integrally formed, respectively, to thereby reduce a manufacturing cost and to simplify the fitting process as compared to a case where the sensor main body and the protector are formed by several pieces, respectively. Further, since the assembly portion 11 having the U shape in cross section is not provided at the corner portion C, the sensor main body 20 can be provided with high flexibility at the corner portion C by conforming to a radius thereof without receiving an external force that may cause the sensor main body 20 to be deformed. Thus, a distortion of the sensor can be prevented and an occurrence of wrong operation due to hypersensitive reaction is prevented.

The corner member 30 of the entrapment prevention sensor 1 according to the aforementioned embodiments is not limited to be provided at the corner portion C but can be provided at a corner portion formed between a side edge and a bottom edge (or a side edge and a top edge) of the opening and closing door 2. Further, the entrapment prevention sensor 1 according to the aforementioned embodiments can be arranged at the bottom edge or the top edge of the opening and closing door.

Figure 6:
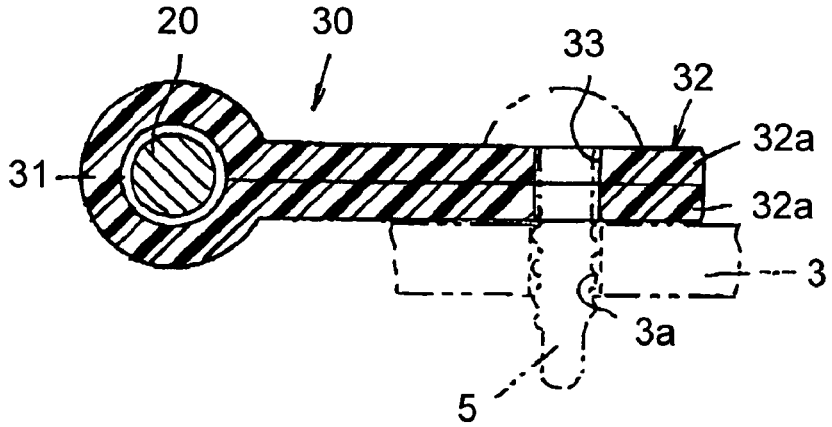
FIG. 6 is a cross-sectional view taken along the line VI-VI in FIG. 5.
Figure 12:
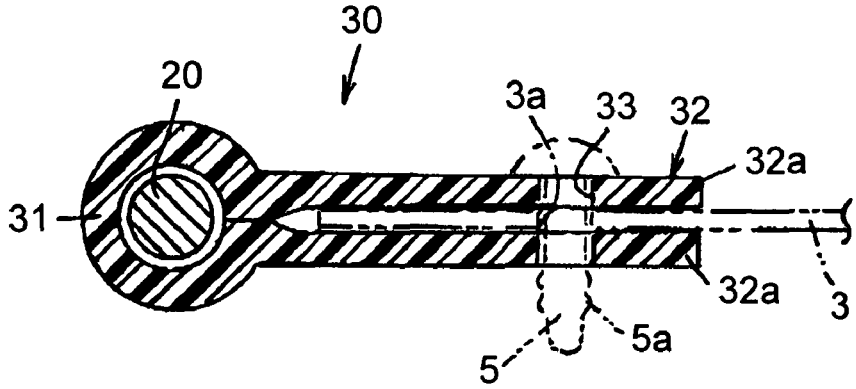
FIG. 12 is a cross-sectional view taken along the line XII-XII in FIG. 5 for illustrating another example of the corner member.

Further, the corner member 30 of the entrapment prevention sensor 1 can be fixed to the fitting flange 3 by various methods other than the method illustrated in FIG. 6. For example, as illustrated in FIG. 12, the fitting flange 3 can be sandwiched between the two plate member 32*a*, and then the retainer clip 5 separately molded can be inserted into the clip bores 33 formed at the respective plate members 32*a* and the fitting bore 3*a* formed at the fitting flange 3 for fixation.

Figure 13:
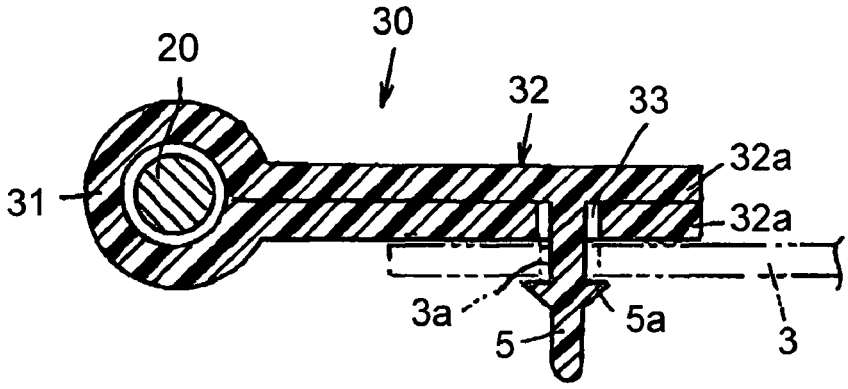
FIG. 13 is a cross-sectional view taken along the line XIII-XIII in FIG. 5 for illustrating still another example of the corner member.

Furthermore, as illustrated in FIG. 13, the retainer clip 5 extending from one of the plate members 32*a* is inserted into the clip bore 33 formed at the other one of the plate members 32*a* and is also inserted into the fitting bore 3*a* of the fitting flange 3 in contact with a side face of the other one of the plate members 32.

Figure 14:
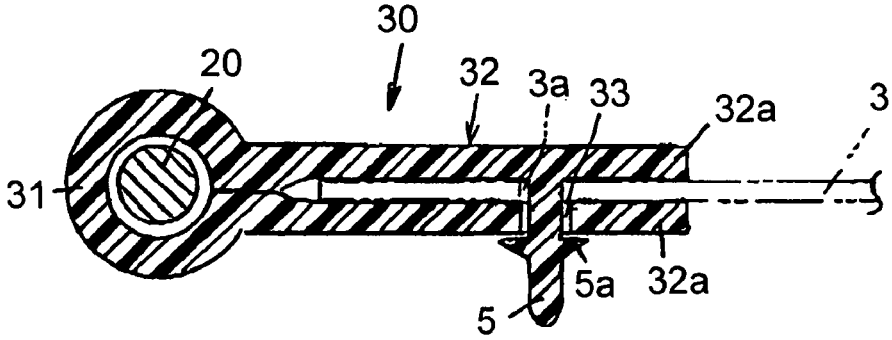
FIG. 14 is a cross-sectional view taken along the line XIV-XIV in FIG. 5 for illustrating still another example of the corner member.

Furthermore, as illustrated in FIG. 14, the fitting flange 3 is sandwiched between the two plate member 32, and then the retainer clip 5 extending from one of the plate members 32*a* is inserted into the fitting bore 3*a* of the fitting flange 3 and the clip bore 33 formed at the other one of the plate members 32*a* for fixation. In each of the cases illustrated in FIGS. 13 and 14, the retainer clip 5 includes a projection 5*a* for preventing the retainer clip 5 from falling off. The retainer clip 5 extending from one of the plate members 32*a* as illustrated in FIGS. 13 and 14 can be molded by the same material as the plate members 32*a*. Alternatively, the retainer clip 5 that has been separately molded beforehand by a material with higher hardness than that of the plate members 32*a* such as hard resin material can be integrally formed with the plate members 32*a* upon molding of the corner member 30.

According to the aforementioned embodiments, the entrapment prevention sensor is provided at the opening and closing door 2. However, the entrapment prevention sensor can be provided at the periphery of the body opening portion adjacent to the opening and closing door.

Further, according to the aforementioned embodiments, the opening and closing door is a backdoor. However, the entrapment prevention sensor can be applied to other types of opening and closing doors having the corner portion.

According to the aforementioned first embodiment, the protector 10 is not provided at the corner portion C. Instead of the protector 10, provided at the corner portion C of the opening and closing door 2 or the periphery of the body opening portion is the corner member 30 constituted by the fixed plate portion 32 having the flat plate shape, and the receiving portion 31 having the curved and hollow shape and integrally formed with the fixed plate portion 32. The fixed plate portion 32 is fixed to the fitting flange 3 while the receiving portion 31 accommodates the sensor main body 20. Thus, the sensor main body 20 can be also provided at the corner portion C. As a result, the non-detectable area can be eliminated and thus the entrapment of the obstacle can be securely detected, thereby further appropriately avoiding the entrapment.

Further, the sensor main body 20 is formed as an integral structure, which leads to a reduced manufacturing cost and a simple fitting process.

Furthermore, the corner member 30 is fixed to the fitting flange 3 by means of the retainer clip 5 inserted into the clip bore 33 that is formed at the fixed plate portion 32, thereby further simplifying the fitting process.

According to the aforementioned second embodiment, the protector 10 is configured only by the hollow portion 12 at the corner portion C. At the same time, provided at the corner portion C of the opening and closing door 2 or the periphery of the body opening portion is the corner member 30 constituted by the fixed plate portion 32 having the flat plate shape, and the receiving portion 31 having the curved and hollow shape and integrally formed with the fixed plate portion 32. The fixed plate portion 32 is fixed to the fitting flange 3 while the receiving portion 31 accommodates the hollow portion 12 that receives the sensor main body 20 therein. Thus, the sensor main body 20 can be also provided at the corner portion C. As a result, the non-detectable area can be eliminated and thus the entrapment of the obstacle can be securely detected, thereby further appropriately avoiding the entrapment.

Further, the sensor main body 20 is formed as an integral structure, which leads to a reduced manufacturing cost and a simple fitting process. The corner member 30 is fixed by means of the retainer clip 5, which leads to the further simple fitting process.

According to the aforementioned first and second embodiments, the corner member 30 forms into the split pin shape in cross section. Thus, the two plate members 32*a* can be opened so as to bring the receiving portion 31 to an open state and to accommodate the sensor main body 20 or the hollow portion 12. As a result, the accommodating process in addition to the fitting process of the corner member 30 can be simplified.

Further, according to the aforementioned second embodiment, the retainer clip 5 integrally formed with one of the plate members 32*a* extend therefrom towards the other one of the plate members 32*a*. Thus, the retainer clip 5 is prevented from being separately molded, which may lead to an easy handling of the retainer clip 5. Since the retainer clip 5 is inserted into the clip bore 33 formed at the other one of the plate members 32*a*, the insertion process can be simplified.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An entrapment prevention sensor for an opening and closing door of a vehicle, the entrapment prevention sensor detecting an entrapment of an obstacle between an opening and closing door constituting a first member and including a corner portion and a periphery of a body opening portion constituting a second member and relative to which the opening and closing door approaches and separates, comprising:

a protector made of an elastic member and including an assembly portion and a hollow portion that is integrally formed with the assembly portion, the assembly portion having a U shape in cross section and being assembled onto a fitting flange provided at one of the first and second members, the assembly portion prevented from being provided at the corner portion;

a sensor main body accommodated within the hollow portion of the protector;

a corner member provided at the corner portion and including a receiving portion and a fixed plate portion that is integrally formed with the receiving portion, the receiving portion having a hollow and curved shape corresponding to a shape of the corner portion and accommodating the sensor main body, the fixed plate portion including a flat plane shape and a clip bore and fixed to the fitting flange by means of a clip; and wherein the corner member includes two plate members overlapping each other, and a portion of the receiving portion facing the fixed plate portion is divided into two parts, which are integrally connected to the respective plate members to form a split pin shape.

2. An entrapment prevention sensor for an opening and closing door of a vehicle, of a power driven opening and closing type and including a corner portion, the entrapment prevention sensor detecting an entrapment of an obstacle between the opening and closing door and a body, comprising:

a protector made of an elastic member and including an assembly portion and a hollow portion that is integrally formed with the assembly portion, the assembly portion having a U shape in cross section and being assembled onto a fitting flange provided at the opening and closing door;

the protector prevented from being provided at the corner portion;

a sensor main body accommodated within the hollow portion of the protector;

a corner member provided at the corner portion and including a receiving portion and a fixed plate portion that is integrally formed with the receiving portion, the receiving portion having a hollow and curved shape corresponding to a shape of the corner portion and accommodating the sensor main body, the fixed plate portion including a flat plane shape and a clip bore and fixed to the fitting flange by means of a clip; and wherein the corner member includes two plate members overlapping each other, and a portion of the receiving portion facing the fixed plate portion is divided into two parts, which are integrally connected to the respective plate members to form a split pin shape.

3. An entrapment prevention sensor for an opening and closing door of a vehicle, of a power driven opening and closing type and including a corner portion, the entrapment prevention sensor detecting an entrapment of an obstacle between the opening and closing door and a body, comprising:

a protector made of an elastic member and including an assembly portion and a hollow portion that is integrally formed with the assembly portion, the assembly portion having a U shape in cross section and being assembled onto a fitting flange provided at the opening and closing door;

the protector configured only by the hollow portion at the corner portion of the opening and closing door;

a sensor main body accommodated within the hollow portion of the protector;

a corner member provided at the corner portion and including a receiving portion and a fixed plate portion that is integrally formed with the receiving portion, the receiving portion having a hollow and curved shape corresponding to a shape of the corner portion and accommodating the hollow portion, the fixed plate portion including a flat plane shape and a clip bore and fixed to the fitting flange by means of a clip; and wherein the corner member includes two plate members overlapping each other, and a portion of the receiving portion facing the fixed plate portion is divided into two parts, which are integrally connected to the respective plate members to form a split pin shape.

4. An entrapment prevention sensor for an opening and closing door of a vehicle, the entrapment prevention sensor detecting an entrapment of an obstacle between an opening and closing door constituting a first member and including a corner portion and a periphery of a body opening portion constituting a second member and relative to which the opening and closing door approaches and separates, comprising:

a protector made of an elastic member and including an assembly portion and a hollow portion that is integrally formed with the assembly portion, the assembly portion having a U shape in cross section and being assembled onto a fitting flange provided at one of the first and second members, the assembly portion prevented from being provided at the corner portion;

a sensor main body accommodated within the hollow portion of the protector;

a corner member provided at the corner portion and including a receiving portion and a fixed plate portion that is integrally formed with the receiving portion, the receiving portion having a hollow and curved shape corresponding to a shape of the corner portion and accommodating the sensor main body, the fixed plate portion including a flat plane shape and a clip bore and fixed to the fitting flange by means of a clip; and wherein the corner member includes two plate members overlapping each other, and a portion of the receiving portion facing the fixed plate portion is divided into two parts, which are integrally connected to the respective plate members to form a split pin shape, the one of the plate members being integrally formed with a clip extending therefrom towards the other one of the plate members while the other one of the plate members being formed with a clip bore through which the clip is inserted.

5. An entrapment prevention sensor for an opening and closing door of a vehicle, of a power driven opening and closing type and including a corner portion, the entrapment prevention sensor detecting an entrapment of an obstacle between the opening and closing door and a body, comprising:

a protector made of an elastic member and including an assembly portion and a hollow portion that is integrally formed with the assembly portion, the assembly portion having a U shape in cross section and being assembled onto a fitting flange provided at the opening and closing door;

the protector prevented from being provided at the corner portion;

a sensor main body accommodated within the hollow portion of the protector;

a corner member provided at the corner portion and including a receiving portion and a fixed plate portion that is integrally formed with the receiving portion, the receiving portion having a hollow and curved shape corresponding to a shape of the corner portion and accommodating the sensor main body, the fixed plate portion including a flat plane shape and a clip bore and fixed to the fitting flange by means of a clip; and wherein the corner member includes two plate members overlapping each other, and a portion of the receiving portion facing the fixed plate portion is divided into two parts, which are integrally connected to the respective plate members to form a split pin shape, the one of the plate members being integrally formed with a clip extending therefrom towards the other one of the plate members while the other one of the plate members being formed with a clip bore through which the clip is inserted.

6. An entrapment prevention sensor for an opening and closing door of a vehicle, of a power driven opening and closing type and including a corner portion, the entrapment prevention sensor detecting an entrapment of an obstacle between the opening and closing door and a body, comprising:

a protector made of an elastic member and including an assembly portion and a hollow portion that is integrally formed with the assembly portion, the assembly portion having a U shape in cross section and being assembled onto a fitting flange provided at the opening and closing door;

the protector configured only by the hollow portion at the corner portion of the opening and closing door;

a sensor main body accommodated within the hollow portion of the protector;

a corner member provided at the corner portion and including a receiving portion and a fixed plate portion that is integrally formed with the receiving portion, the receiving portion having a hollow and curved shape corresponding to a shape of the corner portion and accommodating the hollow portion, the fixed plate portion including a flat plane shape and a clip bore and fixed to the fitting flange by means of a clip; and wherein the corner member includes two plate members overlapping each other, and a portion of the receiving portion facing the fixed plate portion is divided into two parts, which are integrally connected to the respective plate members to form a split pin shape, the one of the plate members being integrally formed with a clip extending therefrom towards the other one of the plate members while the other one of the plate members being formed with a clip bore through which the clip is inserted.

* * * * *